US008918931B1

(12) United States Patent
Baker et al.

(10) Patent No.: US 8,918,931 B1
(45) Date of Patent: Dec. 30, 2014

(54) BED ACCESSORY

(75) Inventors: Randal S. Baker, Ada, MI (US); Arlyn J. Boorsma, Grand Rapids, MI (US); Bryan J. Roodvoets, Caledonia, MI (US)

(73) Assignee: SimpleIdeas, LLC, Grand Rapids, MI (US)

( * ) Notice: Subject to any disclaimer, the term of this patent is extended or adjusted under 35 U.S.C. 154(b) by 318 days.

(21) Appl. No.: 13/403,233

(22) Filed: Feb. 23, 2012

Related U.S. Application Data

(60) Provisional application No. 61/445,635, filed on Feb. 23, 2011.

(51) Int. Cl.
*A47C 21/02* (2006.01)

(52) U.S. Cl.
USPC ..... 5/498; 5/482; 5/494; 5/496; 5/658; 5/659

(58) Field of Classification Search
CPC ..... A47G 9/0238; A47G 9/02; A47G 9/04; A47C 21/022; A47C 21/028
USPC ..... 5/482, 487, 488, 494, 496, 498, 499, 5/503.1, 504.1, 658, 659; 24/545, 457, 24/72.5
See application file for complete search history.

(56) References Cited

U.S. PATENT DOCUMENTS 1,252,885 A * 1/1918 Cook ..... 24/535
2,223,412 A 12/1940 Gartz
3,196,468 A 7/1965 McWilliams
3,790,770 A 2/1974 Stern
4,191,354 A 3/1980 Chia-Liu
4,276,667 A 7/1981 Osbourne
4,465,255 A 8/1984 Hill
4,541,137 A 9/1985 Murray
4,662,016 A * 5/1987 Seeman ..... 5/658
4,710,992 A * 12/1987 Falwell et al. ..... 5/663
4,753,561 A * 6/1988 Betterton et al. ..... 411/182
4,794,660 A * 1/1989 Hawkrigg ..... 5/498
4,802,249 A * 2/1989 Bills ..... 5/420
4,809,377 A * 3/1989 Lynn ..... 5/658
4,967,434 A * 11/1990 Hill ..... 5/658
5,016,617 A 5/1991 Tarlow et al.
5,033,139 A 7/1991 Renfro
5,400,478 A 3/1995 Levinsohn et al.

(Continued)

OTHER PUBLICATIONS

Information pertaining to inventorship of the various claims and lack of obligation to assign (discussed in transmittal letter).

*Primary Examiner* — Robert G Santos
*Assistant Examiner* — David E Sosnowski
(74) *Attorney, Agent, or Firm* — Gardner, Linn, Burkhart & Flory, LLP

(57) ABSTRACT

A bed accessory, for use with a bed having a mattress and a base for the mattress, includes a bed cover retainer having a first portion adapted to fit between the mattress and the base for the mattress. The first portion defines a wedge that is configured to produce a separation force between the mattress and base to hold the retainer in position. The first portion may further define a bed-cover-engaging member, such as a high-friction surface, to hold the bed cover in position. A sleeper attendant may be supported at a second portion. The sleeper attendant is adapted to support an object in a manner that the object is accessible to a sleeper on the bed.

14 Claims, 14 Drawing Sheets

(56) References Cited

U.S. PATENT DOCUMENTS

| | | | | |
|---|---|---|---|---|
| 5,437,067 | A | 8/1995 | Bernstein et al. | |
| 5,640,726 | A | 6/1997 | Fichner-Rathus | |
| 5,802,681 | A * | 9/1998 | Riley et al. | 24/326 |
| 5,884,888 | A | 3/1999 | Grimes, III et al. | |
| 5,946,751 | A | 9/1999 | DeMay | |
| 6,102,950 | A * | 8/2000 | Vaccaro | 623/17.16 |
| 6,557,194 | B1 * | 5/2003 | Jeffries et al. | 5/504.1 |
| 6,558,424 | B2 * | 5/2003 | Thalgott | 623/17.16 |
| 6,622,960 | B2 * | 9/2003 | Hyde | 242/615 |
| 6,641,596 | B1 * | 11/2003 | Lizardi | 606/232 |
| 6,704,955 | B1 * | 3/2004 | Jeffries et al. | 5/504.1 |
| 6,834,403 | B1 | 12/2004 | Elliott | |
| 6,877,175 | B1 | 4/2005 | Jeffries et al. | |
| 6,883,192 | B1 * | 4/2005 | Rose et al. | 5/493 |
| 6,907,628 | B2 | 6/2005 | El Guermaai | |
| 7,096,527 | B2 | 8/2006 | Malik | |
| 7,296,311 | B1 | 11/2007 | Navarrette | |
| 7,381,213 | B2 * | 6/2008 | Lizardi | 606/232 |
| 7,698,759 | B1 | 4/2010 | Frasier | |
| 7,836,559 | B2 * | 11/2010 | Menoudakos | 24/3.13 |
| 7,938,847 | B2 * | 5/2011 | Fanton et al. | 606/232 |
| 8,028,381 | B2 * | 10/2011 | Murray | 24/460 |
| D701,064 | S * | 3/2014 | Baker et al. | D6/607 |
| 8,721,650 | B2 * | 5/2014 | Fanton et al. | 606/99 |
| 2003/0102468 | A1 * | 6/2003 | Selzer | 254/104 |
| 2007/0120034 | A1 | 5/2007 | Sparling | |
| 2007/0260259 | A1 * | 11/2007 | Fanton et al. | 606/99 |
| 2008/0040856 | A1 | 2/2008 | Adamson et al. | |
| 2008/0275469 | A1 * | 11/2008 | Fanton et al. | 606/139 |
| 2010/0242226 | A1 * | 9/2010 | Hopkins et al. | 16/82 |
| 2013/0121773 | A1 * | 5/2013 | Gilmour | 405/259.4 |

* cited by examiner

BED ACCESSORY

CROSS REFERENCE TO RELATED APPLICATIONS

This application claims priority from U.S. patent application Ser. No. 61/445,635 filed Feb. 23, 2011, the disclosure of which is hereby incorporated herein by reference in its entirety.

BACKGROUND OF THE INVENTION

The present invention is directed to a bed accessory and, in particular, to a bed accessory that fits between the mattress and base below the mattress. The bed accessory may include a bed cover retainer that retains the bed covers from pulling out from under the mattress. The bed accessory may include a sleeper attendant that provides useful functionality at the location of the occupant of the bed. Both functions may be combined in a particular embodiment of the invention.

Bed covers are usually tucked under the mattress, particularly at the foot of the bed. For tall sleepers, it is difficult to keep the covers tucked. Also, in some locations, such as hotels, even the bottom sheet is a plain sheet and prone to coming untucked, even at the top of the bed, leading to not only inconvenience but also a potentially unhealthy environment.

Bed cover retainers have been proposed in the past. Such bed cover retainers have suffered from being cumbersome to use and ineffective at holding the bed covers tucked under the mattress.

SUMMARY OF THE INVENTION

The present invention provides a bed accessory for use with a bed having a mattress and a base for the mattress and includes a bed cover retainer having a first portion that is adapted to fit between the mattress and the base for the mattress. The first portion is configured to produce a separation force between the mattress and base to hold the retainer in position. The first portion further defines a bed-cover-engaging member, such as a high-friction surface, to hold the bed cover in position.

A bed accessory for use with a bed having a mattress and a base for the mattress, according to an aspect of the invention, includes a bed cover retainer having a first portion adapted to fit between the mattress and the base for the mattress. The first portion defines a wedge that is configured to produce a separation force between the mattress and base to hold the retainer in position. The first portion also defines a high-friction surface to hold the bed cover in position.

The wedge may be made up of first and second members and a bias. The bias is configured to bias the first and second members away from each other. A hinge may be included between adjacent end portions of the first and second members. The hinge may be a living hinge.

The high-friction surface may be adapted to provide higher friction to a motion to remove the retainer from between the mattress and the base for the mattress than to a motion to insert the retainer between the mattress and the base for the mattress. The high-friction surface may be defined by a surface pattern formed on the first and/or second members. The high-friction surface may be defined by a fish-scaled surface pattern on the first and/or second members.

The bed cover retainer may have a second portion that is configured to extend outwardly of the mattress. The second portion may be in the form of (one or more) outwardly extending flanges that are configured to engage a perimeter rib or bead of the mattress or the base bead for the mattress.

A sleeper attendant may be supported at the second portion of said bed cover retainer for supporting an object in a manner that the object is accessible to a sleeper on the bed. The sleeper attendant may include a generally planar surface for supporting an object, such as a cellular telephone, a tablet computer, or the like. The sleeper attendant may include one or more adjustable clamps for securing an article. The sleeper attendant may include (i) an electrical outlet, (ii) a light source, (iii) a plug that is adapted to be connected to an electrical power source, and/or (iv) a data jack that is configured to be connected to a source of digital data.

The sleeper attendant may be supported from the second portion of the bed cover retainer by a generally vertical support member. The generally vertical support member may include an adjustable support portion.

A bed accessory for use with a bed having a mattress and a base for the mattress, according to another aspect of the invention, may include a first portion that is configured to fit between the mattress and the base of the mattress and a second portion that is adapted to extend outwardly of the mattress. A sleeper attendant is supported at the second portion in a manner that the object is accessible to a sleeper on the bed.

The sleeper attendant may include a generally planar surface for supporting an object. The sleeper attendant may include one or more adjustable clamps for securing an article. The sleeper attendant may include (i) an electrical outlet, (ii) a light source, (iii) a plug that is adapted to be connected to an electrical power source, and/or (iv) a data jack that is configured to be connected to a source of digital data.

The sleeper attendant may be supported from the second portion of the bed cover retainer by a generally vertical support member. The generally vertical support member may include an adjustable support portion.

The first portion may include a convex surface portion. The concave surface portion may define a high-friction surface. The high-friction surface may be adapted to provide higher friction to a motion to remove the first portion from between the mattress and the base for the mattress than to a motion to insert the first portion between the mattress and the base for the mattress. The high-friction surface may be defined by a surface pattern formed on the first portion. The high-friction surface may be defined by a fish-scale surface pattern on said first portion.

The first portion may include a concave surface portion. The first portion may be generally circular in plan view.

A bed accessory, according to various embodiments of the invention, may be used when addressing the difficulty, for example, of retaining the bed covers in a hotel room. The sheets typically are not fitted which allows them to come loose at any portion of the bed. A bed accessory having a sleeper attendant may be used toward the head of the bed to service the sleeper who is positioned away from the nightstand. The electrical plug may be connected to an electrical outlet next to the bed. A bed accessory without a sleeper attendant may be used at each of the other three corners of the bed to retain the bed covers.

It should be understood that embodiments of the invention may find various applications, including dormitory rooms, hospital rooms, children's rooms, and the like. For multiple sleepers, the sleeper attendant may be used on one side of the bed for a sleeper who prefers the covers tucked in while allowing the other side of the bed to accommodate a sleeper who prefers untucked covers. Also, because it functions almost entirely from between the mattress and base, the various embodiments of the bed accessory disclosed herein can be used on beds with headboards and/or footboards because the device can be inserted from the side of the bed near the corners thereof.

These and other objects, advantages and features of this invention will become apparent upon review of the following specification in conjunction with the drawings.

DESCRIPTION OF THE PREFERRED EMBODIMENT

Figure 1:
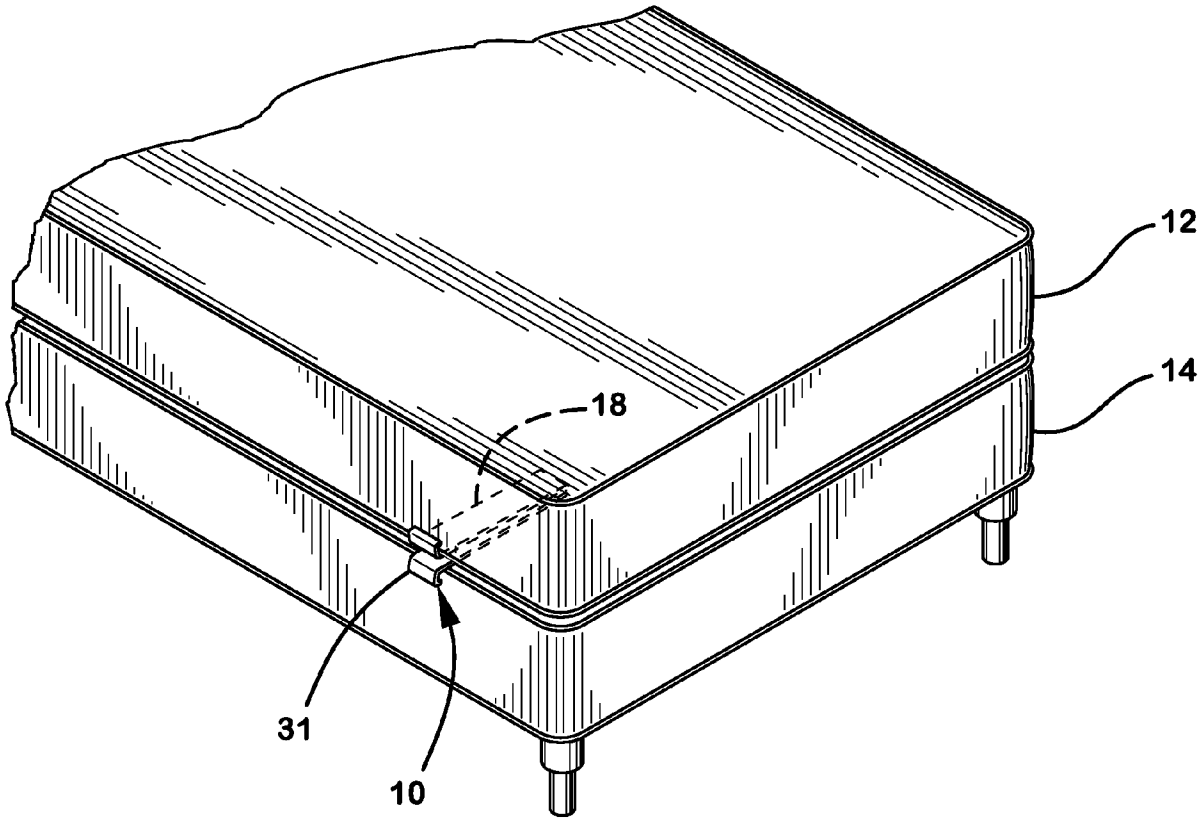
FIG. 1 is a perspective view illustrating a bed accessory, according to an embodiment of the invention, positioned between a mattress and a mattress base, such as a box spring.
Figure 2:
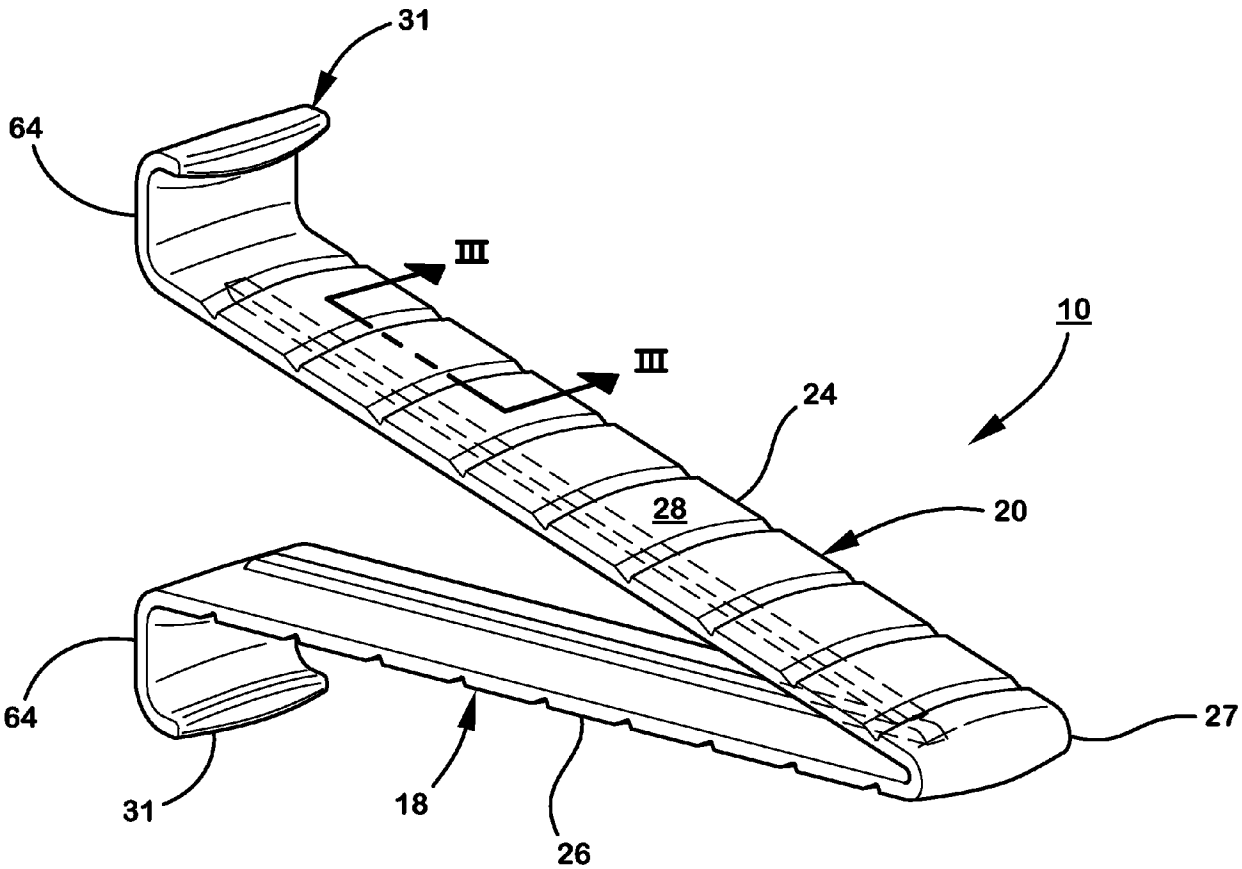
FIG. 2 is a perspective view of the bed accessory in FIG. 1.
Figure 3:
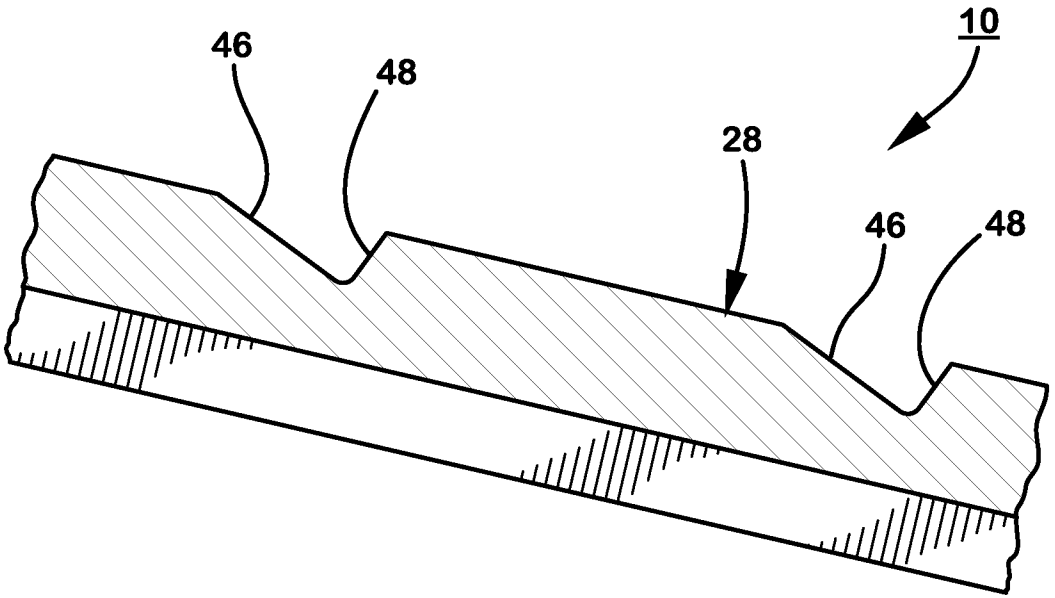
FIG. 3 is a sectional view taken along the lines in FIG. 2.

Referring now to the drawings and the illustrative embodiments depicted therein, a bed accessory 10 is provided for use with a bed having a mattress 12 and a base 14 for the mattress (FIGS. 1-4). Base 14 may be a conventional box spring, a spring assembly, such as the type used in a foldout sleeper-sofa, a rigid surface, such as of the type used in a dormitory bed, or the like. Accessory 10 is a bed cover retainer that is configured to hold the covers to the bed. Bed cover retainer 16 includes a first portion 18 that is configured to fit between mattress 12 and base 14. First portion 18 defines a wedge 20 formed by diverging surfaces that is configured to produce a separation force between mattress 12 and base 14 to hold retainer 10 in position between the mattress and base. First portion 18 further defining a bed-cover-engaging portion, such as a high-friction surface 28, to engage and hold the bed cover in position.

Figure 4:
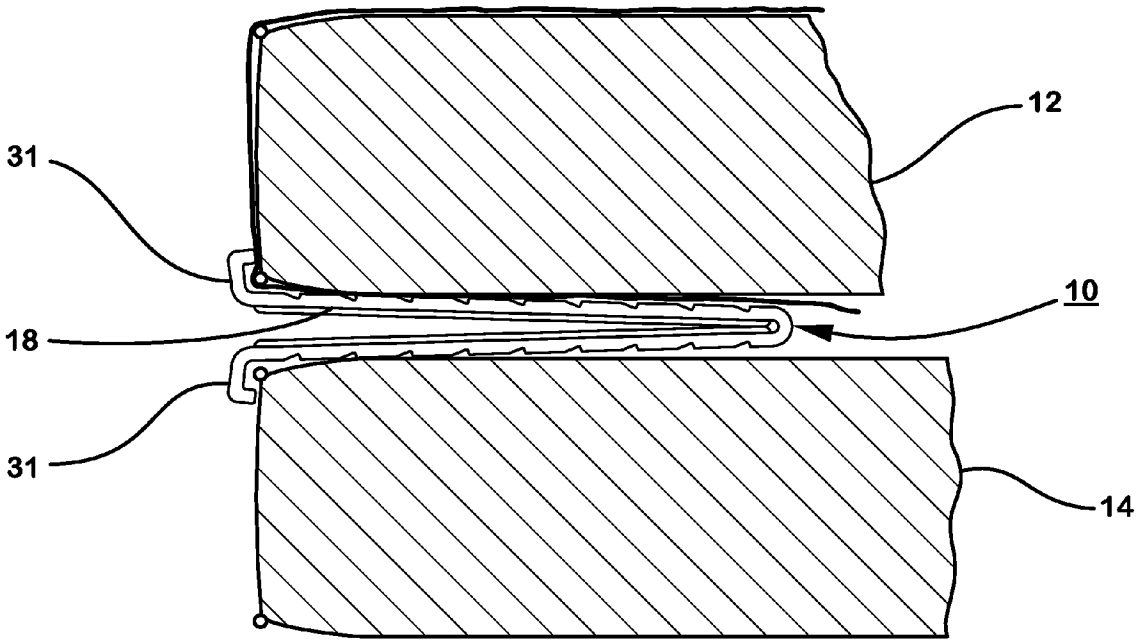
FIG. 4 is a side elevation illustrating the bed accessory in FIG. 1 in relationship to the mattress and the mattress support.
Figure 5:
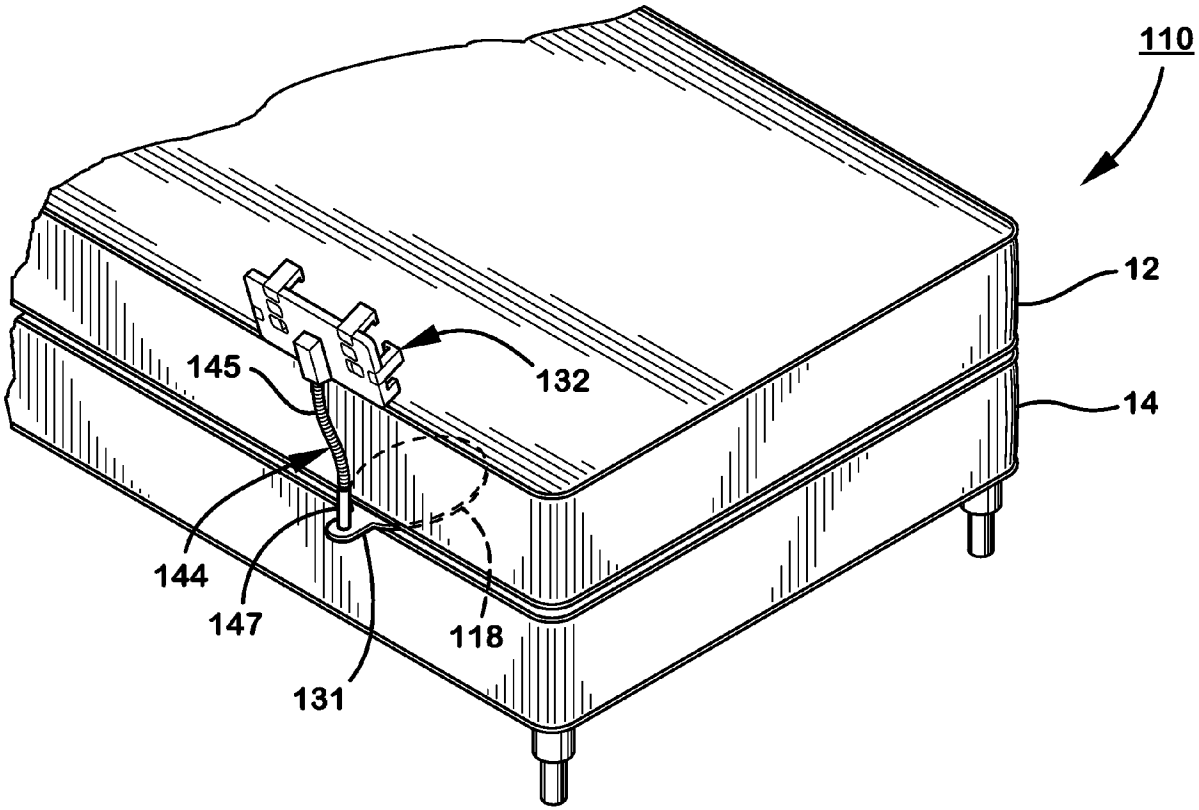
FIG. 5 is the same view as FIG. 1 of a bed accessory, according to an embodiment of the invention, positioned between a mattress and a mattress base.
Figure 6:
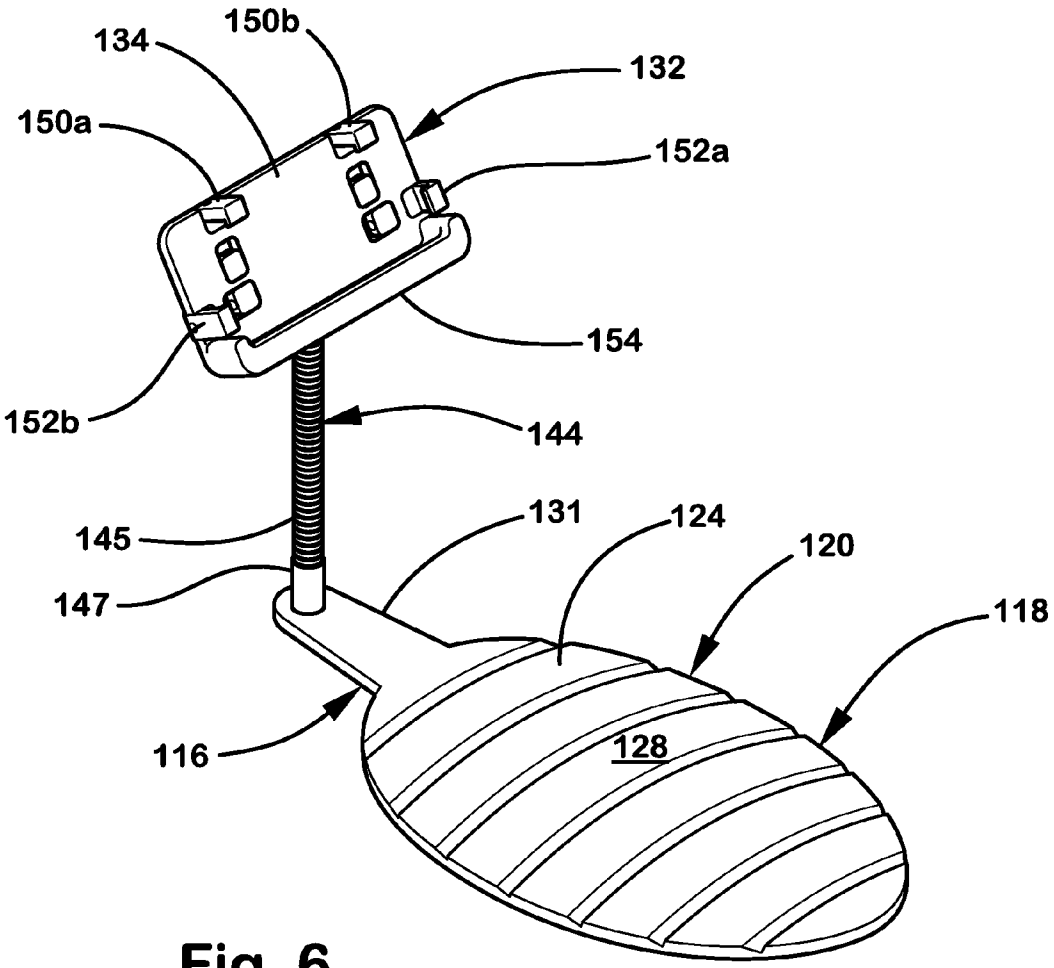
FIG. 6 is a perspective view of the bed accessory in FIG. 5.

Wedge 20 may include a first member 24, a second member 26 and a biasing member 27 biasing members 24, 26 away from each other. In the illustrated embodiment, biasing member 27 is formed as a living hinge between first and second members 24, 26, which are formed as a unitary member, such as from plastic molding, or the like. In this manner, when bed cover retainer 10 is slid between the mattress and base, biasing member 27 is compressed thus applying a force against the mattress and base tending to hold wedge 20, and, hence, bed cover retainer 16, in position between the mattress and base, as illustrated in FIG. 4. Although biasing member 27 is illustrated as integral with members 24, 26, such defined by a living hinge or by members 24, 26 being fastened together at their ends in a manner to be biased apart. Alternatively, a portion of one of members 24, 26 may be formed to contact the other member in a biasing manner. While illustrated as separate members that are hinged and biased apart by a biasing member, other configurations of wedge 20 will be apparent to the skilled artisan. For example, wedge 20 could be a single piece wedge-shaped foam member, or the like. Also, other shapes than a pure wedge could be used to perform the function of wedge 20.

High-friction surface 28 may be defined on one or both of first and second members 24, 26 to hold wedge 20 in position between the mattress and the base. High-friction surface 28 engages the bed covers to prevent them from being pulled out. Thus, with wedge 20 holding the bed cover retainer in position and high-friction surface 28 engaging the bed covers, the bed covers are firmly held in position. In the illustrated embodiment, high-friction surface 28 provides a higher friction to the motion of removing the retainer from between mattress 12 and base 14 than to the motion of inserting the retainer between the mattress and base. This makes it relatively easy to insert cover retainer 10 without the need to lift mattress 12 yet provide a strong resistance to the force tending to pull the sheets away from the mattress. In this manner, cover retainer 10 can be easily applied yet tenaciously hold the sheets in place. High-friction surface 28 is able to have different frictional engagement for inserting than removing cover retainer 10 by defining a fish-scale pattern illustrated in FIG. 3. The fish scale pattern is defined by pairs of surfaces 46, 48 in which surfaces 46 have a shallow slope with respect to the outer surface of member 24, and/or member 26, while surfaces 48 have a relatively steep slope approaching perpendicular. Thus, the motion to insert cover retainer 10 encounters gently sloped surfaces 46 which provide very little resistance. However the motion to remove cover retainer 10 encounters steeply sloped surfaces 48 which provide much greater resistance. Other structures would be apparent to the skilled artisan to provide such a unidirectional higher friction surface, including, by way of example, sloped protrusions on one or both of first and second members 24, 26.

High-friction surface 28 may be defined by various other materials known in the art, but may not have the unidirectional high-friction characteristics of the illustrated fish-scale pattern. For example, commercially available plastics are available that are tacky and can be cleaned in order to restore their original surface tackiness. High-friction surface 22 may be defined by a coating applied to a substrate.

Cover retainer 10 includes a second portion 31 that is configured to remain outside of the interface between mattress 12 and base 14. In the illustrated embodiment, second portion 31 is formed as flanges 64 face away from each other but are curved inwardly toward first portion 18. Flanges 64 fit around the ribbing that extends around the perimeter of most mattresses and box springs, if present. This further serves to retain the covers in place by clamping the covers to the ribbing. Second portion 31 also serves as a grasping area to engage in order to remove cover retainer 20.

In one embodiment, a bed accessory 110 includes a horizontal support 116 having a first portion 118 that is configured to fit between mattress 12 and base 14 to firmly support bed accessory 110 and a second portion 131 that is configured to extend outwardly of mattress 12 (FIGS. 5-9). Bed accessory 110 includes a sleeper attendant 132 supported at second portion 131 by a generally vertical support member 144. Sleeper attendant 132 may include a generally planar surface 134 for supporting an object, such as a book, a cell phone, a tablet computer, or the like. Sleeper attendant 132 may include one or more adjustable clamps, such as vertical clamps 150*a*, 150*b*, to clamp an object against a flanged tray 154 and horizontal clamps 152*a*, 152*b* to clamp the sides of an object. Each clamp includes a sliding portion 158 that is slideably retained in an opening in planar surface 134 and a clamping portion 160 that is hook-shaped. An adjusting member 162, such as a threaded rod, may be rotated by a user to adjust the relative spacing between sliding portion 158 and its corresponding clamping portion 160. Vertical support member may include a connector 147 connected with second portion 131 and an adjustable "gooseneck" 145 that allows for lateral adjustment of the position of sleeper attendant 132.

Figure 7:
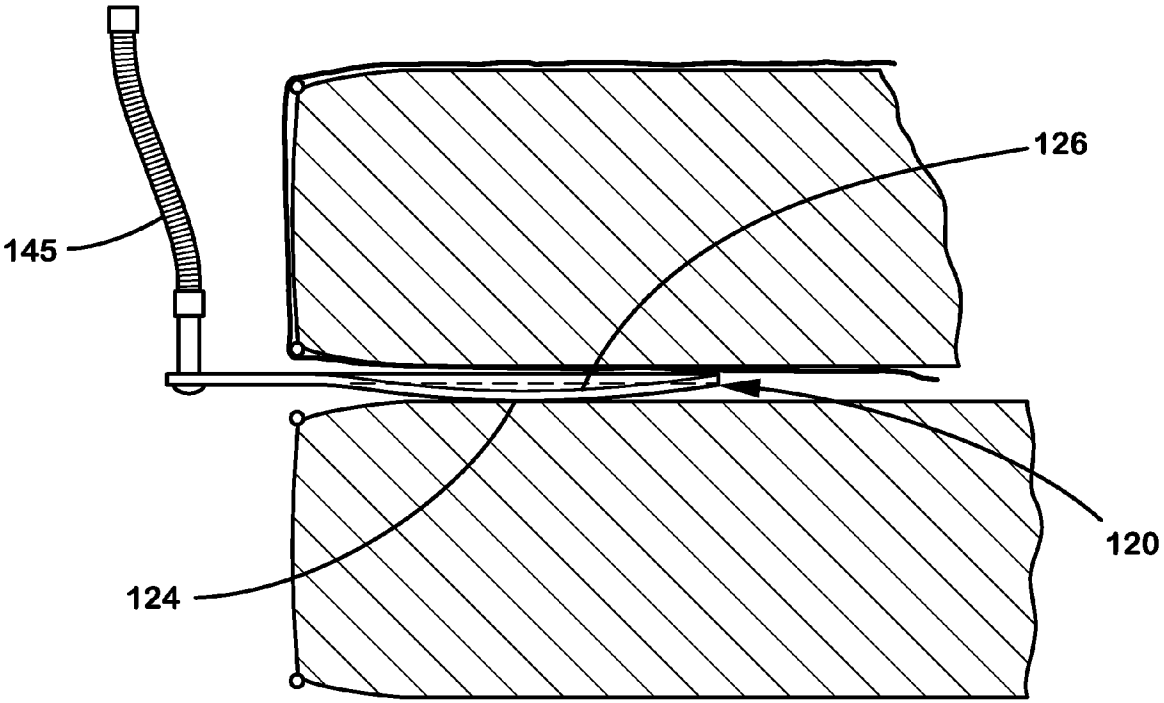
FIG. 7 is a side elevation illustrating the bed accessory in FIG. 5 in relationship to the mattress and the mattress base.
Figure 8:
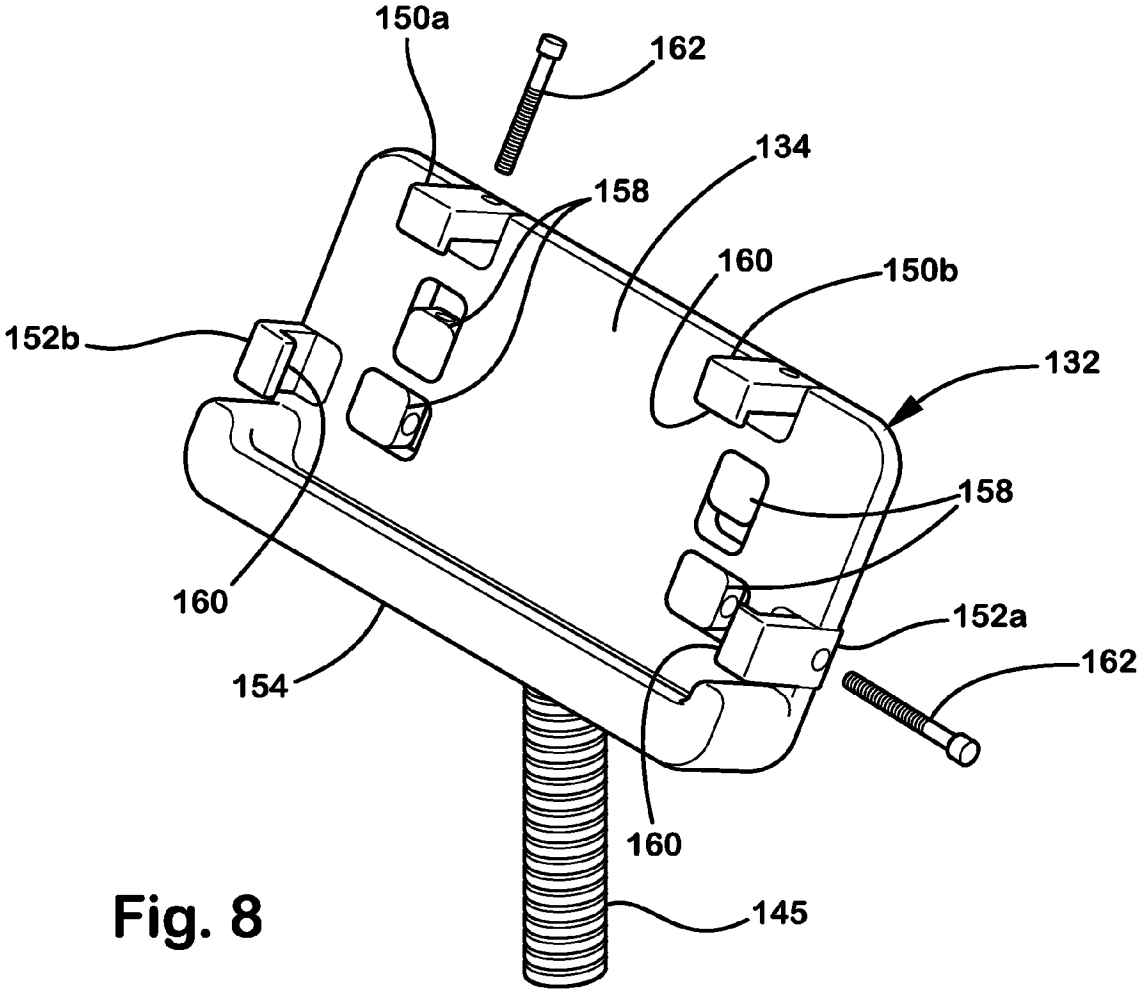
FIG. 8 is a perspective view of the sleeper attendant portion of the bed accessory in FIG. 5 taken from the front thereof.
Figure 9:
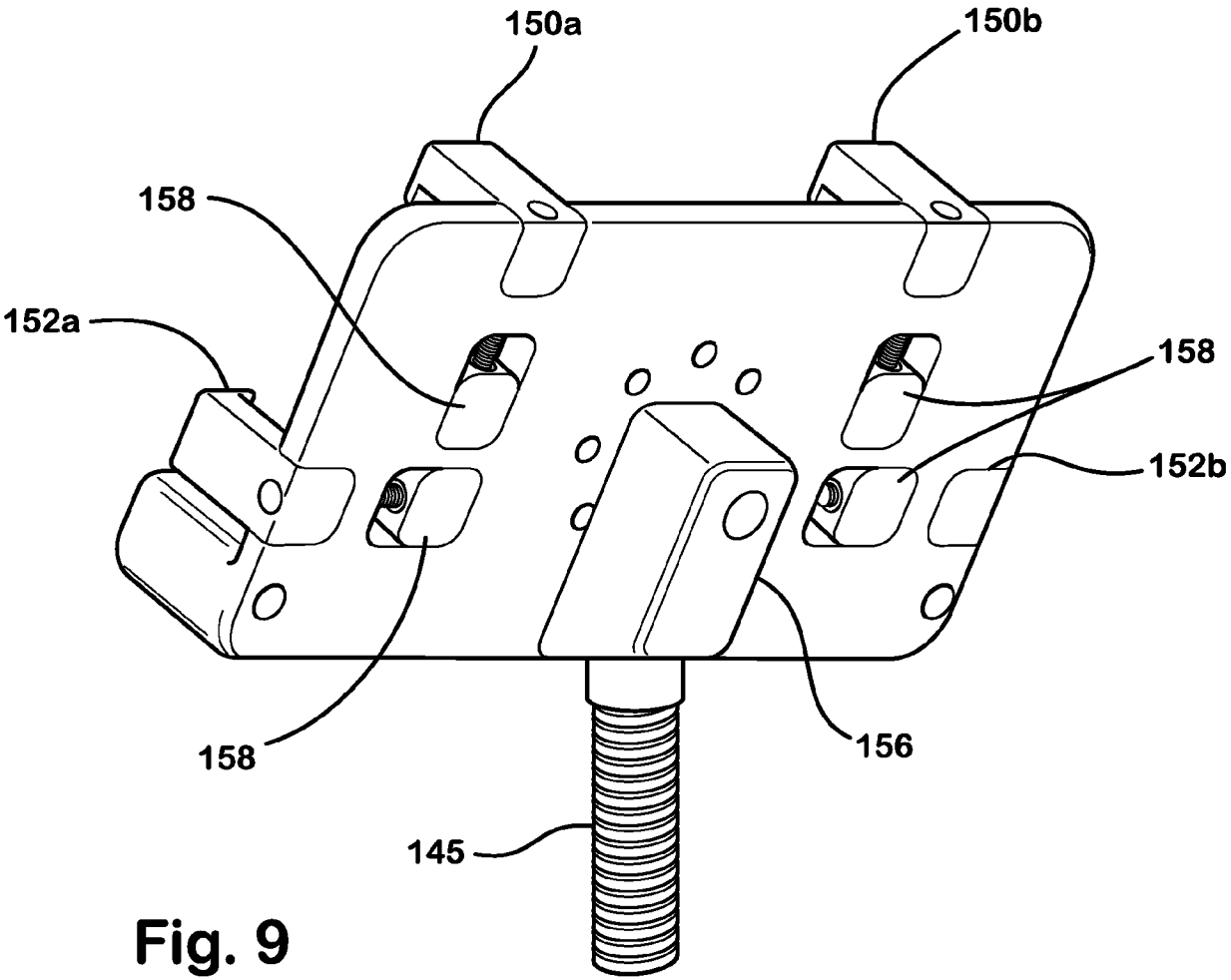
FIG. 9 is a perspective view of the sleeper attendant portion in FIG. 8 taken from the rear thereof.

First portion 118 of support 116 is in the form of a wedge 120 having a generally circular plan configuration, or footprint, to give it stability. The wedge shape is formed by the peak of a convex surface 124 and the outer perimeter of first portion 118 which is below the peak of convex surface 124, as best seen in FIG. 7. A concave surface 126 is on the opposite side of convex surface 124. Either or both surfaces 124, 126 may be provided with a high-friction surface 128. High-friction surface 128 helps to capture first portion 118 in its position captured between mattress 12 and base 14. First portion 118 may be in the form of a fish-scale similar to high-friction surface 28, whereby first portion 118 may be inserted between mattress 12 and base 14 with less force than the force tending to resist removal of the device. While support 116 is primarily intended to provide a rugged mounting for sleeper attendant 132, the skilled artisan will recognize that it also tends to retain the covers on the bed in a similar fashion to the functions performed by cover retainer 10.

Figure 10:
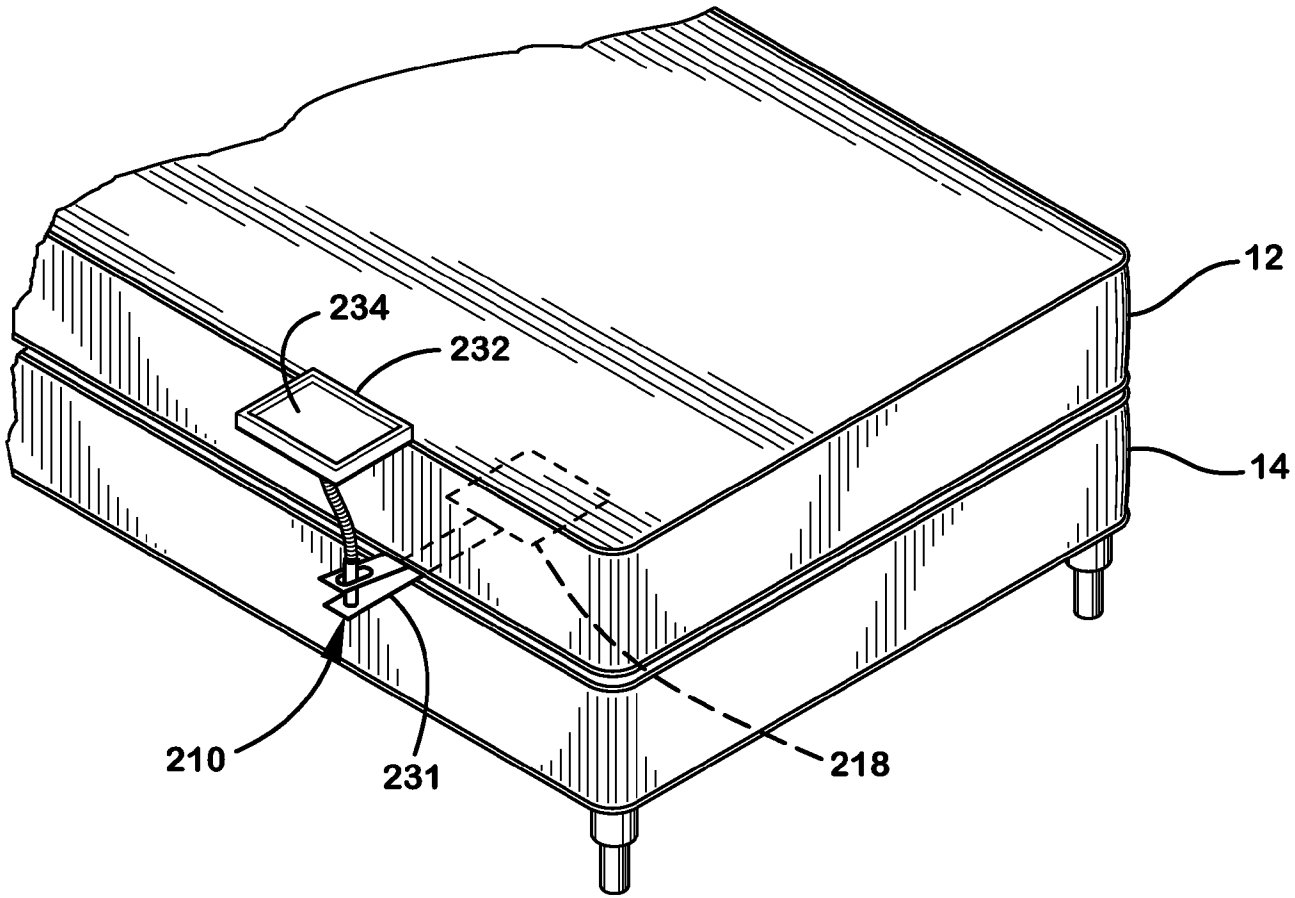
FIG. 10 is the same view as FIG. 5 of an alternative embodiment of a bed accessory.
Figure 11:
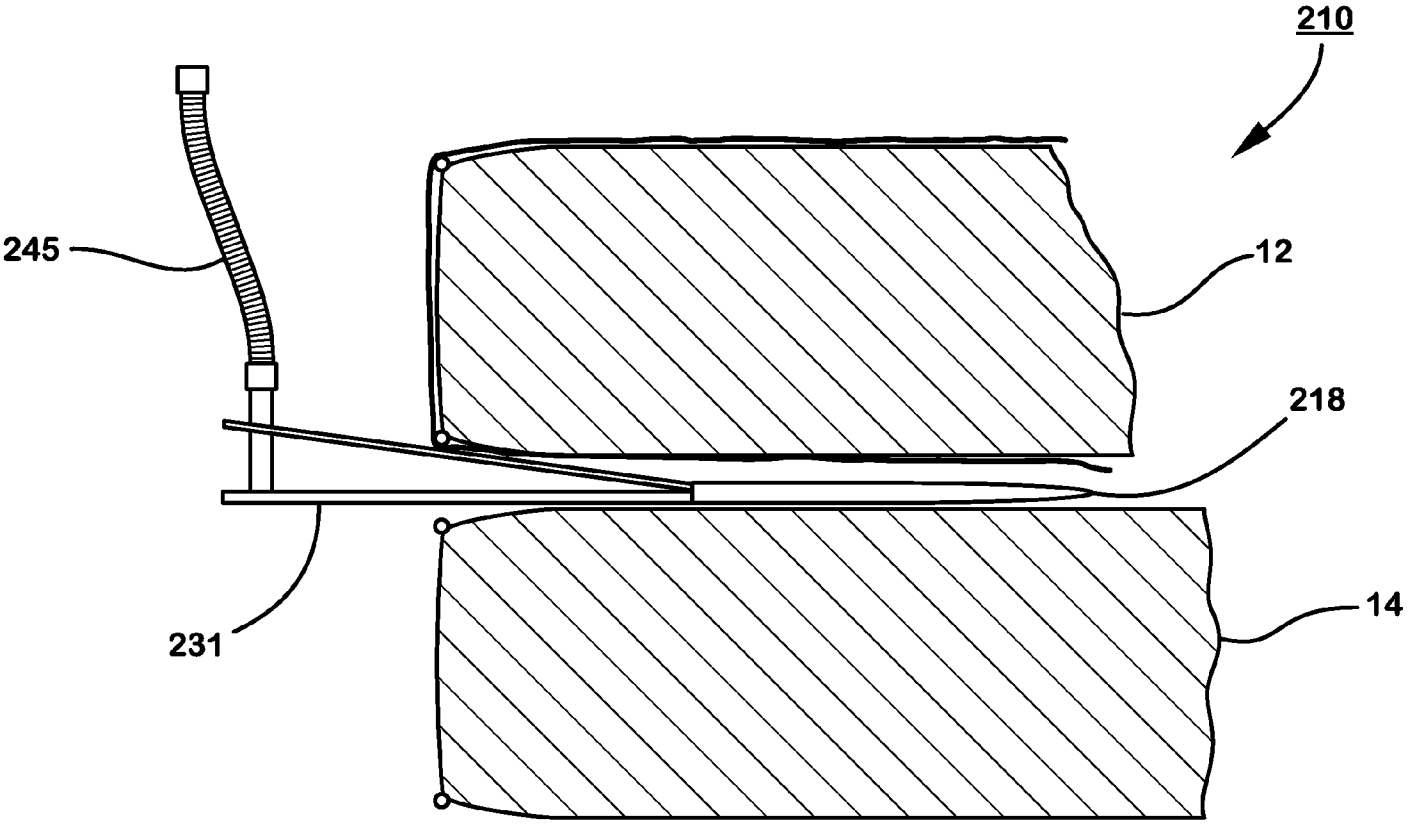
FIG. 11 is a side elevation illustrating the bed accessory in FIG. 10 in relationship to the mattress and the mattress base.
Figure 12:
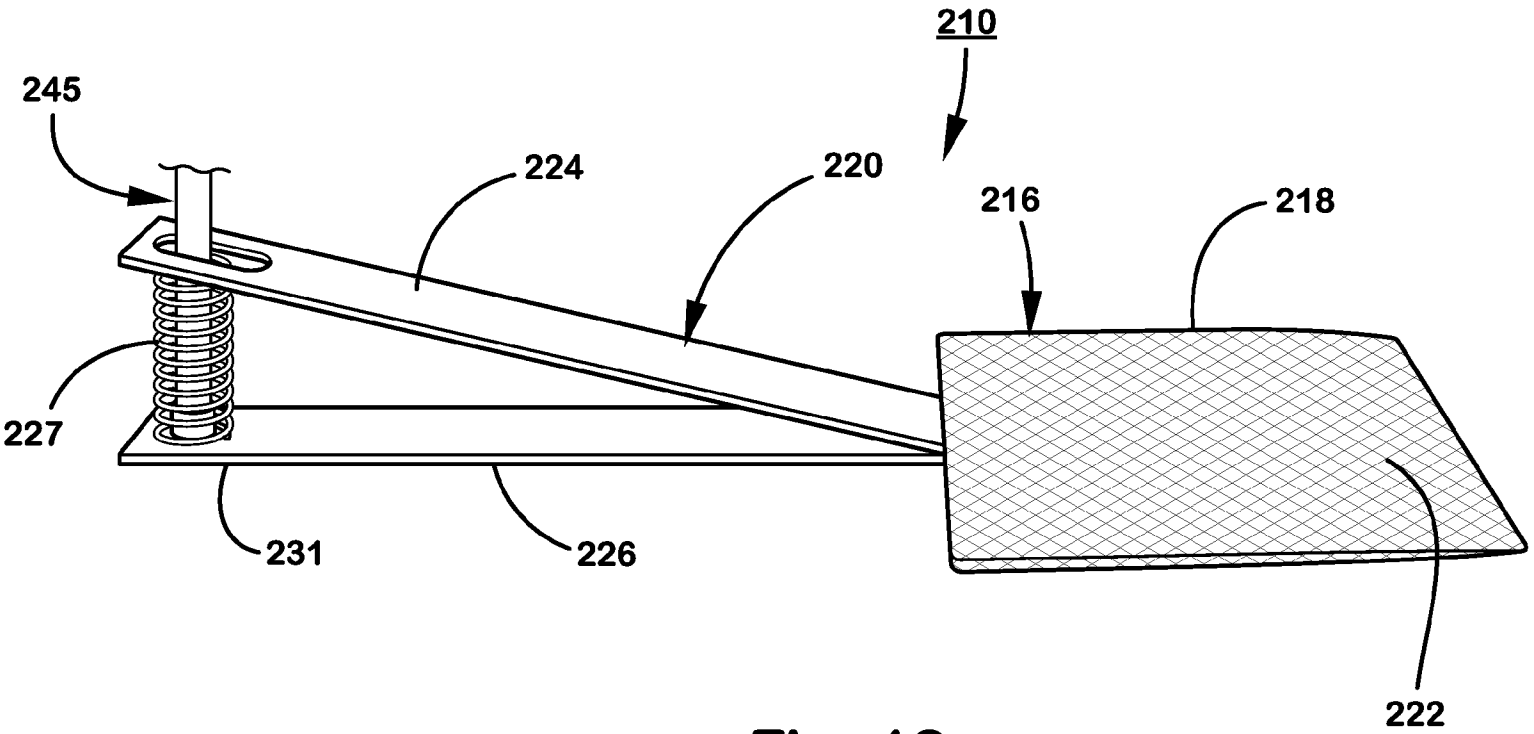
FIG. 12 is a perspective view of the bed accessory in FIG. 10 with the sleeper attendant not shown.
Figure 13:
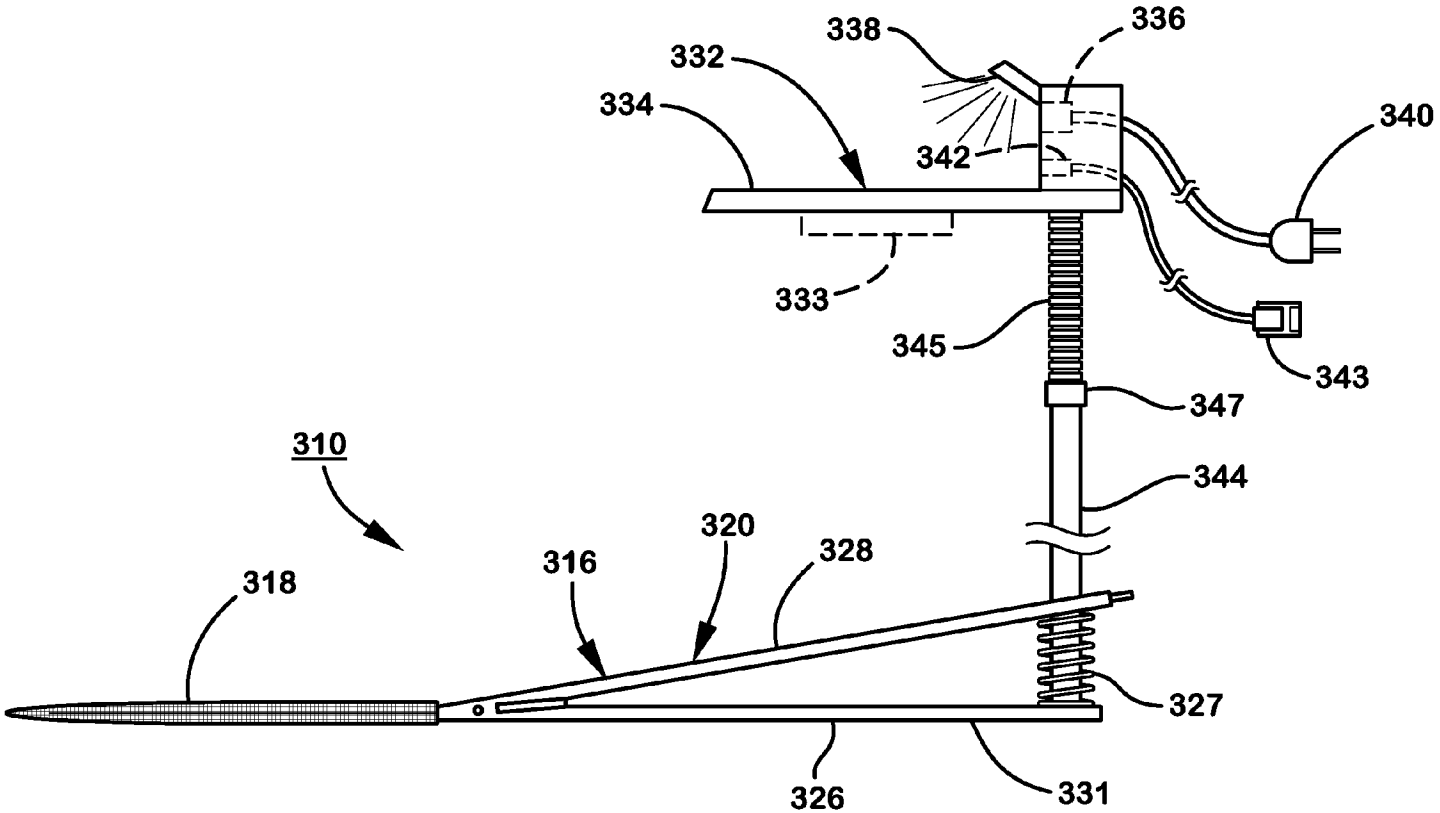
FIG. 13 is a perspective view of a bed accessory, according to yet another embodiment of the invention.
Figure 14:
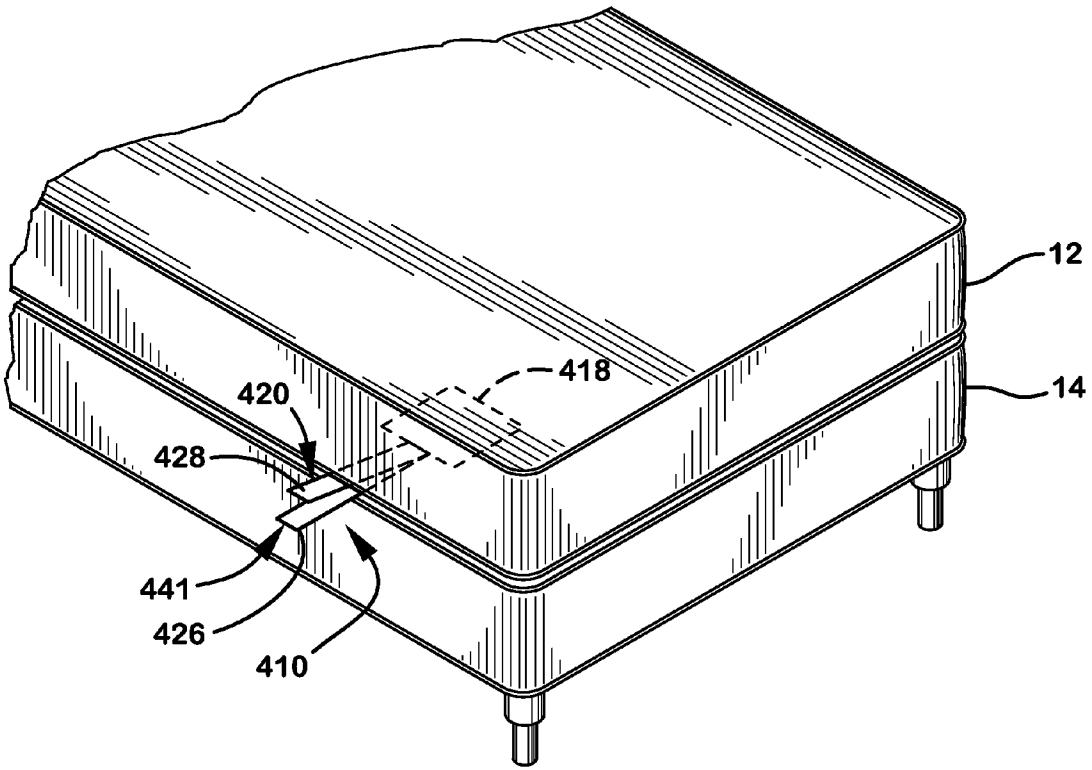
FIG. 14 is the same view as FIG. 1 of yet another alternative embodiment thereof.

In yet a further embodiment, a bed accessory 210 includes a support 216 having a first portion 218 that is supported between mattress 12 and base 14 and a second portion 231 that supports a sleeper attendant 132 (FIGS. 10-12). A vertical support member 245 supports sleeper attendant 232 from support 216. Support 216 includes a wedge 220 formed by a first member 224 and a second member 226 that are hinged to each other at one end and biased apart at the opposite end by a biasing member, such as a compression spring 227. A high-friction surface 218 may be the surface of a separate member 222 that both provides stability and helps to retain the bed covers from pulling out. Wedge 220 helps to retain support 216 in place.

In yet a further embodiment, a bed accessory 310 includes a support 316 that is similar to support 216 and having first and second members 326, 328 that are biased apart at one end by a biasing member 327. A high-friction surface functions in the same manner as high-friction surface 218. A sleeper attendant 332 may include a generally planar surface 334 and an electrical outlet 336 that is electrically connected with a plug 343 by a cord 340 that is adapted to be connected with an electrical power source. Alternatively, or additionally, sleeper attendant 332 may include an inductive charging element 333 that may be used to inductively supply electrical energy to a charging sleeve (not shown) to charge a cell phone, or the like, support therein. Because many cell phones have an alarm clock function, sleeper attendant 332 may facilitate such function. Sleeper attendant 332 may further include a light source 338 of the type that is well known in the art. Sleeper attendant 332 may further include a data jack 342 that is configured to be connected, such as with a connector 343, with a source of digital data, such as a router, or the like.

Sleeper attendant 332 may be separable from generally vertical support member 344 by a quick release connector pair 347. A "gooseneck" 345 may be provided between sleeper attendant 332 and connector pair 347 to allow adjustment of the location of the sleeper attendant. Cord 340 and/or the cable between data jack 342 and connector 343 may pass through gooseneck 345. While bed accessory 310 may include a support 116 that is capable of retaining bed covers in order to provide a combined functionality, the skilled artisan will recognize that a bed cover retainer of the type disclosed herein may be used separately and that sleeper attendant 332 may be supported by a device that inserts between the mattress and base, but does not provide a bed cover retainer function.

In yet an additional embodiment, a bed accessory 410 is similar to support 316 of bed accessory 410 but without a sleeper attendant. Bed accessory 410 may include a first portion 318 that is configured to fit between the mattress and base to retain the bed covers. A removable member, such as a cover, that is removable from first portion 418 may be used to define a high-friction surface to allow it to be removed and washed as needed to restore its surface characteristics. It may also include a wedge 420 in the form of a first member 326 and 328 that serves to retain the bed accessory in place between the mattress and base.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments.

The embodiments of the invention in which an exclusive property or privilege is claimed are defined as follows:

1. A bed accessory for use with a bed having a mattress and a base for the mattress, said accessory comprising:

a bed cover retainer having a first portion adapted to fit between the mattress and the base for the mattress and a second portion that is configured to extend outwardly of the mattress and the base for the mattress;

said first portion defining a wedge wherein said wedge comprises first and second members that are portions of a unitary member and joined together at one end portion and movable toward each other and a bias, said bias biasing said first and second members away from each other when moved toward each other thereby producing a separation force when inserted between the mattress and base tending to hold the retainer in position and the bed cover against the mattress;

said first portion defining an outwardly extending high-friction surface on at least one chosen from said first and second members wherein said high-friction surface provides a higher resistance to a motion in one direction than to a motion in an opposite direction wherein resistance to a force positioning said first portion between the mattress and the base for the mattress is lower than a force retaining said first portion between the mattress and the base for the mattress; and said second portion defining flanges on said first and second members that face away from each other and return inwardly toward said first portion to fit around any ribbing around the mattress and the base.

2. The bed accessory as claimed in claim 1 wherein said bias includes a hinge joining said first and second members at said one end portion.

3. The bed accessory as claimed in claim 2 wherein said hinge comprises a living hinge.

4. The bed accessory as claimed in claim 1 wherein said high-friction surface is defined by a surface pattern formed on said at least one of said first and second members.

5. The bed accessory as claimed in claim 4 wherein said high-friction surface is defined by a fish-scale surface pattern on said at least one of said first and second members.

6. The bed accessory as claimed in claim 1 wherein said flanges are generally curved.

7. The bed accessory as claimed in claim 1 wherein said outwardly extending high-friction surface is on both said first and second members.

8. A bed having a mattress and a base for the mattress and bed cover on said mattress; and a bed cover retainer having a first portion adapted to fit between the mattress and the base for the mattress and a second portion that is configured to extend outwardly of the mattress and the base for the mattress, said first portion defining a wedge wherein said wedge comprises first and second members that are portions of a unitary member and joined together at one end portion and moveable toward each other and a bias, said bias biasing said first and second members away from each other when moved toward each other thereby producing a separation force when inserted between the mattress and base tending to hold the retainer in position and the bed cover against the mattress, said first portion defining an outwardly extending high-friction surface on at least one chosen from said first and second members wherein said high-friction surface provides a higher resistance to a motion in one direction than to a motion in an opposite direction wherein resistance to a force positioning said first portion between the mattress and the base for the mattress is lower than a force retaining said first portion between the mattress and the base for the mattress and wherein said second portion defining flanges on said first and second members that face away from each other and return inwardly toward said first portion to fit around any ribbing around the mattress and the base.

9. The bed as claimed in claim 8 wherein said bias includes a hinge joining said first and second members at said one end portion.

10. The bed as claimed in claim 9 wherein said hinge comprises a living hinge.

11. The bed as claimed in claim 8 wherein said high-friction surface is defined by a surface pattern formed on said at least one of said first and second members.

12. The bed as claimed in claim 11 wherein said high-friction surface is defined by a fish-scale surface pattern on said at least one of said first and second members.

13. The bed as claimed in claim 8 wherein said flanges are generally curved.

14. The bed as claimed in claim 8 wherein said outwardly extending high-friction surface is on both said first and second members.

* * * * *